US006761651B2

(12) United States Patent
Pai

(10) Patent No.: US 6,761,651 B2
(45) Date of Patent: Jul. 13, 2004

(54) ALUMINUM TENNIS RACKET

(76) Inventor: Chin-Dong Pai, 20-3 Fl., No. 123, Sec. 3, Jonggang Rd., Taichung (TW)

( * ) Notice: Subject to any disclaimer, the term of this patent is extended or adjusted under 35 U.S.C. 154(b) by 0 days.

(21) Appl. No.: 10/301,751

(22) Filed: Nov. 22, 2002

(65) Prior Publication Data

US 2004/0102262 A1 May 27, 2004

(51) Int. Cl.[7] ..... A63B 49/02
(52) U.S. Cl. ..... 473/545; 473/546; 473/524
(58) Field of Search ..... 473/524, 545, 473/535, 537, 546

(56) References Cited

U.S. PATENT DOCUMENTS 1,422,993 A * 7/1922 Larned ..... 428/592
1,451,836 A * 4/1923 Larned ..... 473/545
1,541,829 A * 6/1925 Larned ..... 473/545
1,694,360 A * 12/1928 Larned ..... 428/591
1,750,727 A * 3/1930 Norton ..... 473/545
5,368,296 A * 11/1994 Liu ..... 473/524
5,462,274 A * 10/1995 Takatsuka ..... 473/537
5,573,242 A * 11/1996 Yoo ..... 473/521
6,447,412 B1 * 9/2002 Filippini ..... 473/524

FOREIGN PATENT DOCUMENTS

GB 2203653 * 10/1988 ..... 473/FOR 181
WO 94/00203 * 1/1994 ..... 473/FOR 171

* cited by examiner

*Primary Examiner*—Raleigh W. Chiu
(74) *Attorney, Agent, or Firm*—Troxell Law Office PLLC

(57) ABSTRACT

An aluminum tennis racket includes a head, a shaft and a handle. The head and the shaft are made of hollow aluminum tubing with a series of ripples. The ripples are defined on a sidewall of the hollow aluminum tubing, and the ripples increase the strength of the head and the shaft so the sidewall is lighter and thinner. The lighter tennis racket helps a player to quick react, and the increased strength allows the player to strike a ball powerfully.

3 Claims, 4 Drawing Sheets

ALUMINUM TENNIS RACKET

BACKGROUND OF THE INVENTION

1. Field of the Invention

The present invention relates to an aluminum tennis racket, and more particularly to an aluminum tennis racket made of hollow aluminum tubing with a series of ripples to increase strength of the tennis racket and make the tennis racket lighter.

2. Description of Related Art

A racket is used to hit a ball in tennis. A player holds the racket to hit the ball over a net and scores when the opponent cannot return the ball over the net. Having a strong and light racket is important because a light racket helps the player to react quickly, and a strong racket allows the player to hit the ball powerfully. For this purpose, one type of racket is made of hollow aluminum tubing.

With reference to FIG. 4, a convention racket (20) includes a head (21) and a shaft (22). The head (21) has a lower side (not numbered) and is manufactured by bending hollow aluminum tubing to a desired shape. Two ends of the hollow aluminum tubing extend from the lower side of the head (21) and form the shaft (22).

With reference to FIG. 5, the conventional hollow aluminum tubing (23) used to make the racket (20) has a sidewall (231) and an inner space (232). To reduce the weight of the racket (20), the sidewall (231) of the hollow aluminum tubing (23) is as thin as possible. Generally, the hollow aluminum tubing (23) is manufactured by an aluminum extrusion process. When the hollow aluminum tubing (23) is shaped into the head (21), the hollow aluminum tubing (23) must be bent. In the bending process, a wrinkle or crease is easily formed in the thin wall because the hollow aluminum tubing (23) is weak.

Reducing the thickness of the sidewall (231) of the hollow aluminum tubing (23) results in a lighter racket (20). However, it also makes fabricating the racket (20) more difficult and weakens the strength of the racket (20).

To overcome the shortcomings, the present invention provides an improved aluminum tennis racket to mitigate the aforementioned problems.

SUMMARY OF THE INVENTION

The main objective of the invention is to provide an improved aluminum tennis racket that is light and very strong by incorporating a series of ripples in the hollow aluminum tubing.

Other objectives, advantages and novel features of the invention will become more apparent from the following detailed description when taken in conjunction with the accompanying drawings.

DETAILED DESCRIPTION OF PREFERRED EMBODIMENT

Figure 1:
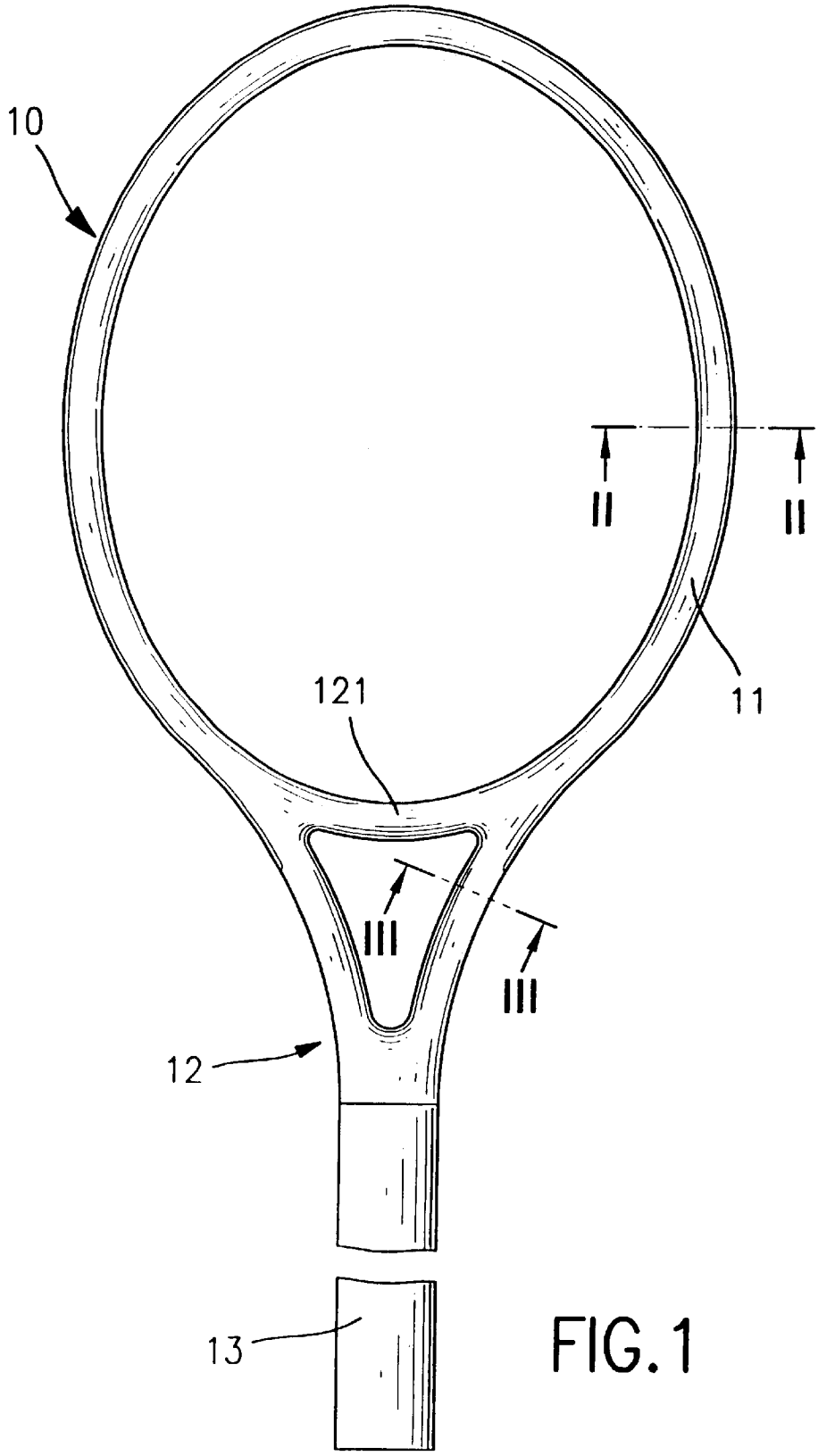
FIG. 1 is a front plan view of a tennis racket in accordance with the present invention.

With reference to FIG. 1, a tennis racket (10) in accordance with the present invention includes a head (11), a shaft (12), a yoke (121) and a handle (13). The head (11), is adapted to mount strings (not shown) and has a lower side (not numbered) and an oval shape. The head (11) is manufactured by bending hollow aluminum tubing that has two ends. The ends of the hollow aluminum tubing extend from the lower side of the head (11) to form the shaft (12). The handle (13) is attached to the shaft (12) or formed directly on the shaft (12) by molding with polyurethane foam. The yoke (121) is attached securely to the head (11) at the lower side so the head (11) stiffness is improved. The handle (13) is adapted to be held by a player. The tennis racket (10) including the head (11) and the shaft (12) that are made out of hollow aluminum tubing can make the tennis racket (10) lighter.

Figure 2:
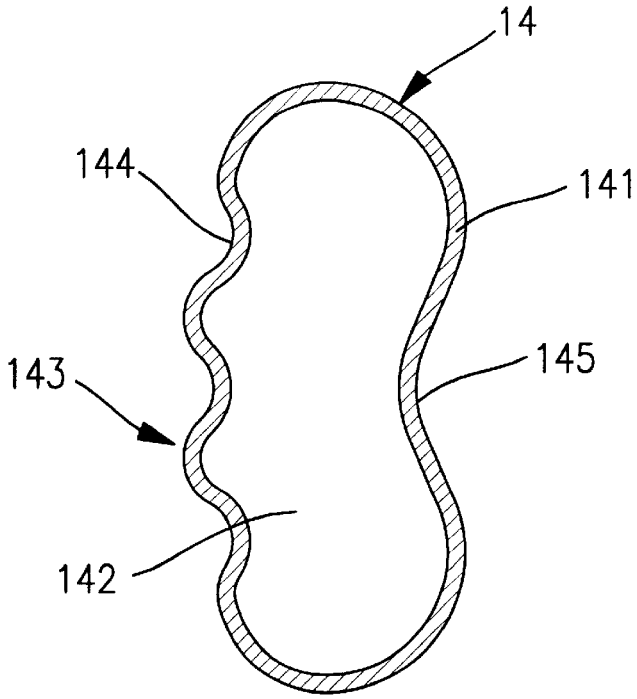
FIG. 2 is a cross-sectional view of the head of the tennis racket along line II—II in FIG. 1.

With reference to FIG. 2, the hollow aluminum tubing (14) used to form the head (11) includes a sidewall (141), an inner space (142), a series of ripples (143) and a string groove (145).

Figure 3:
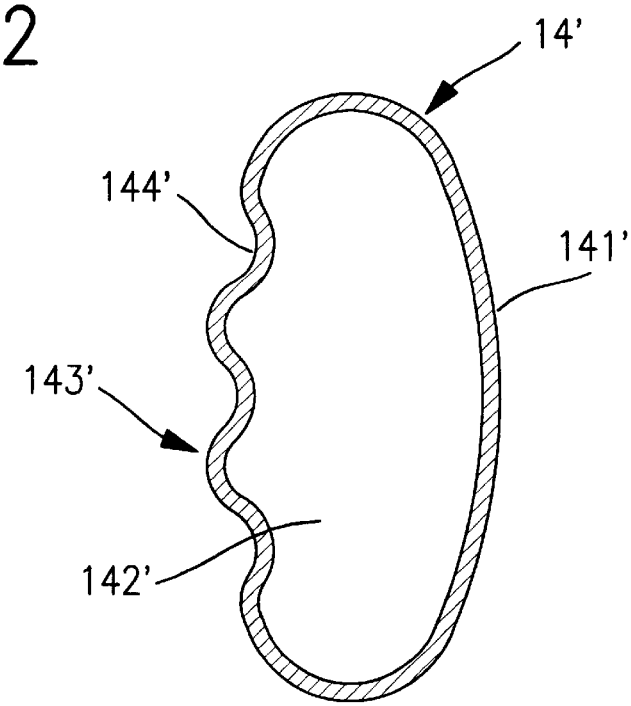
FIG. 3 is a cross-sectional view of the shaft of the tennis racket along line III—III in FIG. 1.
Figure 4:
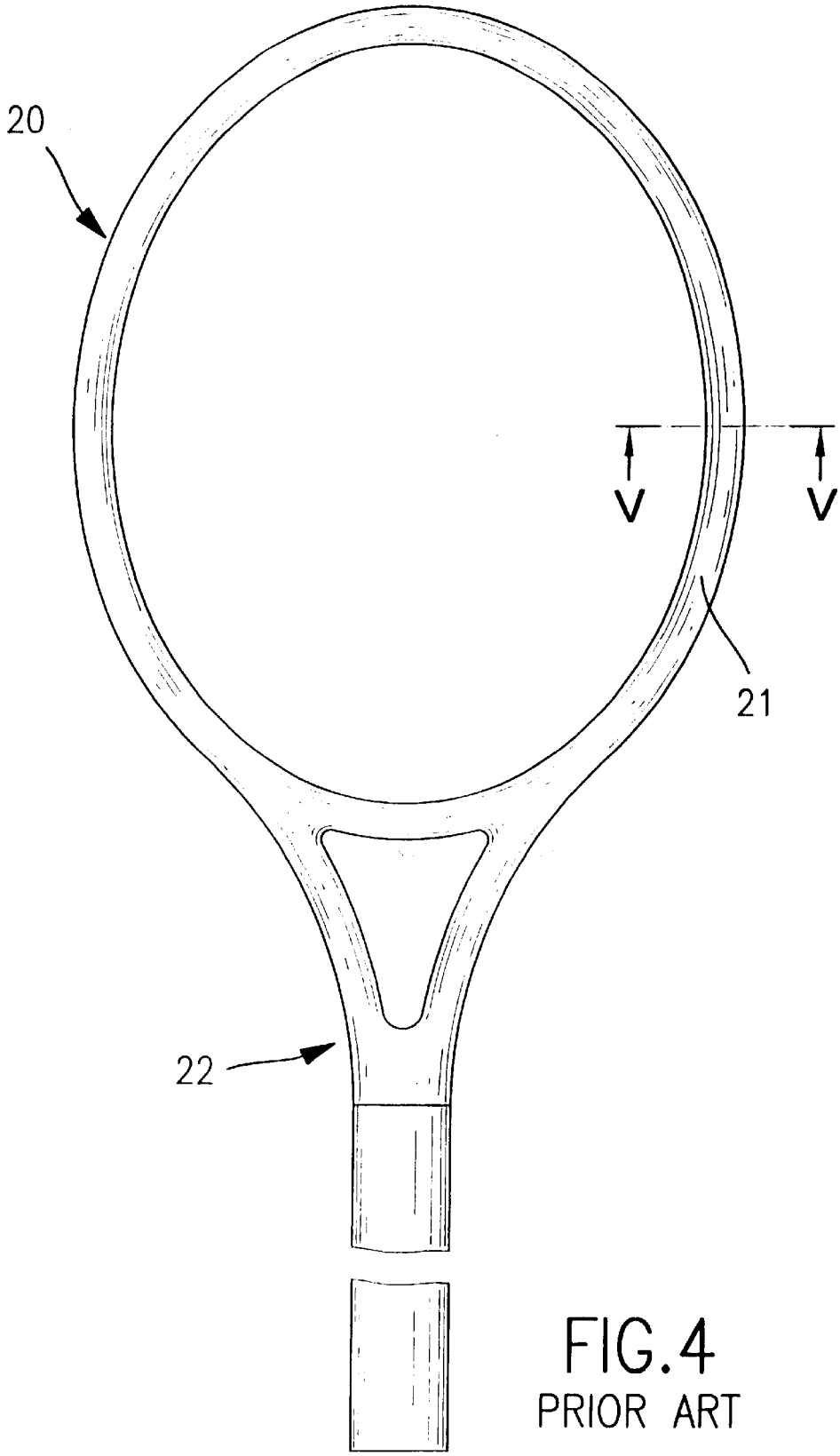
FIG.4 PRIOR ART
FIG. 4 is a front plan view of a conventional tennis racket in accordance with prior art.

With reference to FIG. 3, the hollow aluminum tubing (14') used to form the shaft (12) includes a sidewall (141'), an inner space (22') and a series of ripples (143').

The ripples (143, 143') can be in the shape of a series of sine waves, square waves or triangular waves. The ripples (143, 143') can be formed anywhere on the sidewalls (141, 141'), either along a segment or the entire length of the sidewalls (141, 141').

Figure 5:
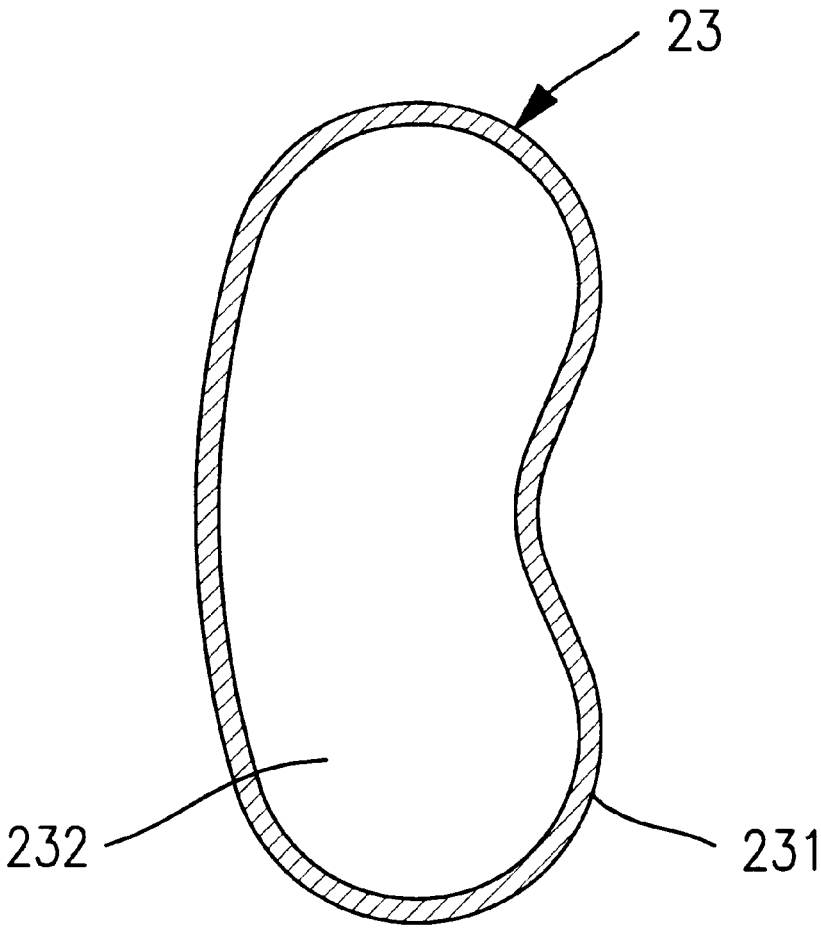
FIG.5 PRIOR ART
FIG. 5 is a cross-sectional view of the conventional tennis racket along line V—V in FIG. 4.

That a corrugated piece can bear a much larger load than a similar flat piece is well known. Accordingly, with reference to FIGS. 2 and 5, if a view of a finite element of the cross-sections of the hollow aluminum tubing (23, 14) is taken, a partial view of the conventional sidewall (231) is considered a flat piece, and a partial view of the sidewall (141) in accordance with the present invention is considered a corrugated piece. With further reference to FIG. 3, the hollow aluminum tubing (23, 14) with the ripples (143, 143') increases resistance to buckling when the tubing is loading. The strength of the tennis racket (10) that is made of the hollow aluminum tubing (14, 14') with ripples (143, 143') will also be improved.

The ripples (143, 143') are formed axially on the sidewalls (140, 141') of the aluminum tubing (14, 14') along the axis of the aluminum tubing (14, 14') during the aluminum extrusion process while the hollow aluminum tubing (14, 14') is being manufactured. Therefore, because the ripples (143, 143') are simultaneously fabricated on the aluminum tubing (14, 14') during the aluminum extrusion process, manufactured the aluminum tubing (143, 143') to form ripples (143, 143') is labor saving and time saving. The ripples (143, 143') can also be formed on the hallow aluminum tubing (143, 143') by a rolling machine. Thus, the thickness of the hollow aluminum tubing (143, 143') can be reduced to make the tennis racket (10) lighter without losing its original strength.

Even though numerous characteristics and advantages of the present invention have been set forth in the foregoing description, together with details of the structure and function of the invention, the disclosure is illustrative only and changes may be made in detail, especially in matters of shape, size, and arrangement of parts within the principles of the invention to the full extent indicated by the broad general meaning of the terms in which the appended claims are expressed.

What is claimed is:

1. An aluminum tennis racket comprising:

a head adapted to mount strings, the head having a lower side and being made of hollow aluminum tubing with a sidewall;

a shaft extending directly from the lower side of the head and the shaft being made of hollow aluminum tubing with a sidewall; and a handle securely attached to the shaft and adapted to be held by a user;

a series of ripples formed axially on the sidewall along an axis of the hollow aluminum tubing wherein the series of ripples are a series of sine waves; and, a yoke attached securely to the head at the lower side, the aluminum tubing further having an inner side, wherein the series of ripples are formed on the inner side of the aluminum tubing of the head.

2. An aluminum tennis racket comprising:

a head adapted to mount strings, the head having a lower side and being made of hollow aluminum tubing with a sidewall;

a shaft extending directly from the lower side of the head and the shaft being made of hollow aluminum tubing with a sidewall; and a handle securely attached to the shaft and adapted to be held by a user; and a series of ripples formed axially on the sidewall along an axis of the hollow aluminum tubing wherein the series of ripples are a series of sine waves; and, a yoke is attached securely to the head at the lower side, the aluminum tubing further has an inner side, and the series of ripples are formed on the sidewall at the inner side of the aluminum tubing of the shaft.

3. An aluminum tennis racket comprising:

a head adapted to mount strings, the head having a lower side and being made of hollow aluminum tubing with a sidewall;

a shaft extending directly from the lower side of the head and the shaft being made of hollow aluminum tubing with a sidewall;

a handle securely attached to the shaft and adapted to be held by a user;

a series of ripples formed axially on the sidewall along an axis of the hollow aluminum tubing wherein the series of ripples are a series of sine waves; and, a yoke is attached securely to the head at the lower side, the aluminum tubing further has an inner side, and the series of ripples are formed on the sidewalls at the inner side of the aluminum tubing of both the head and the shaft.

* * * * *